US009115431B2

(12) United States Patent
Korosec

(10) Patent No.: US 9,115,431 B2
(45) Date of Patent: Aug. 25, 2015

(54) METHODS AND COMPOSITIONS FOR REDUCING STRESS CORROSION CRACKING

(75) Inventor: Philip S. Korosec, Overland Park, KS (US)

(73) Assignee: MIDCONTINENTAL CHEMICAL, Olathe, KS (US)

( * ) Notice: Subject to any disclaimer, the term of this patent is extended or adjusted under 35 U.S.C. 154(b) by 973 days.

(21) Appl. No.: 13/226,009

(22) Filed: Sep. 6, 2011

(65) Prior Publication Data

US 2013/0055629 A1 Mar. 7, 2013

Related U.S. Application Data

(62) Division of application No. 12/692,384, filed on Jan. 22, 2010, now abandoned.

(51) Int. Cl.

| | |
|---|---|
| ***C23F 11/00*** | (2006.01) |
| ***C23F 11/08*** | (2006.01) |
| ***C23F 11/12*** | (2006.01) |
| ***C23F 11/14*** | (2006.01) |
| ***C23F 11/16*** | (2006.01) |
| ***C10L 1/18*** | (2006.01) |
| ***C10L 1/222*** | (2006.01) |
| ***C10L 1/183*** | (2006.01) |
| ***C23F 11/10*** | (2006.01) |
| ***C10L 1/185*** | (2006.01) |
| ***C10L 1/226*** | (2006.01) |
| ***C10L 1/228*** | (2006.01) |
| ***C10L 1/23*** | (2006.01) |
| ***C10L 10/04*** | (2006.01) |

(52) U.S. Cl.

CPC ..... *C23F 11/141* (2013.01); *C10L 1/183* (2013.01); *C10L 1/1832* (2013.01); *C10L 1/1855* (2013.01); *C10L 1/1857* (2013.01); *C10L 1/226* (2013.01); *C10L 1/2225* (2013.01); *C10L 1/2227* (2013.01); *C10L 1/2283* (2013.01); *C10L 1/23* (2013.01); *C10L 10/04* (2013.01); *C23F 11/10* (2013.01); *C23F 11/12* (2013.01); *C10L 2200/0469* (2013.01); *C10L 2230/08* (2013.01); *C10L 2230/14* (2013.01); *C10L 2270/02* (2013.01)

(58) Field of Classification Search

USPC ..... 252/387, 390, 396, 392, 393, 395; 44/451

See application file for complete search history.

(56) References Cited

U.S. PATENT DOCUMENTS

| | | | |
|---|---|---|---|
| 3,897,349 | A | 7/1975 | Marin et al. |
| 3,959,177 | A | 5/1976 | Martin |
| 3,973,056 | A | 8/1976 | Fessler et al. |
| 4,549,968 | A | 10/1985 | Muccitelli |
| 4,959,177 | A | 9/1990 | Schutt |
| 5,176,849 | A | 1/1993 | Hwa et al. |
| 5,472,638 | A | 12/1995 | McLaughlin et al. |
| 5,753,596 | A | 5/1998 | Martin et al. |
| 6,059,992 | A | 5/2000 | Veldman et al. |
| 6,556,642 | B2 | 4/2003 | Hur et al. |
| 2004/0033959 | A1 | 2/2004 | Chen et al. |
| 2005/0166447 | A1 | 8/2005 | Corkwell et al. |
| 2006/0101711 | A1 | 5/2006 | Vincent et al. |
| 2006/0218853 | A1 | 10/2006 | Oh et al. |

OTHER PUBLICATIONS

Beaver et al. Prevention of Internal SCC in Ethanol Pipelines. Paper No. 08153. Corrosion NACE International. 2008.*

ASTM International; Standard Practive for Slow Strain Rate Testing to Evaluate the Susceptibility of Metallic Materials to Environmentally Assisted Cracking; Designation: G 129-00 (Reapproved 2006); 2006; pp. 1-7; ASTM International, 100 Bar Harbor Drive, PO Box C700, West Conshohocken, PA 19428-2959, United States.

Arkema Inc.; Selection Guide for Oxygen Scavengers; Organic Chemicals—Oxygen Scavengers; e-OrganicChemicals.com; 2001, pp. 1-9; Arkema Inc., 2000 Market St., Philadelphia, PA 19103.

John Beavers and Narasi Sridhar; Recent Advances in Understanding Ethanol SCC of Pipelines; Apr. 8, 2008; pp. 1-20; www.cctechnologies.com; CC Technologies (a DNV company), Dublin, OH, USA.

R.D. Kane, J.G. Maldonado, and L.J. Klein; Stress Corrosion Cracking in Fuel Ethanol: A Newly Recognized Phenomenon; 2004; pp. 1-16; NACE International, 1440 South Creek Drive, Houston, TX 77084-4906, United States.

J.G. Maldonado and N. Sridhar; SCC of Carbon Steel in Fuel Ethanol Service: Effect of Corrosion Potential and Ethanol Processing Source; 2007; pp. 1-11; NACE International, 1440 South Creek Drive, Houston, TX 77084-4906, United States.

Michael Curley; Can ethanol be Transported in a Multi-Products Pipeline?; Pipeline & Gas Journal, www.pgjonline.com; May 2008; pp. 1-3; Tulsa, OK, United States.

Dr. Russell D. Kane and Dr. Julio G. Maldonado; Stress Corrosion Cracking of Carbon Steel in Fuel Grade Ethanol: Review and Survey; API Technical Report 939-D, InterCorr International, Inc.; Sep. 2003; pp. 1-44; American Petroleum Institute, Houston, TX.

Nalco Chemical Company; Oxygen Corrosion; Oxygen Scavengers, Questions and Answers; 2000; pp. 1-6; Nalco Chemical Company, One Nalco Center, Naperville, IL, 60563-1198.

Accepta; Oxygen Scavengers—Boiler Water Treatment, Boiler Chemicals 101; Jun. 2004; pp. 1-7; http://www.accepta.com/water_treatment_chemicals/oxygen_scavengers.asp; Accepta—Advanced Environmental Technologies.

Non-final Office Action dated Sep. 27, 2010 in U.S. Appl. No. 12/692,384.

Final Office Action dated Mar. 7, 2011 in U.S. Appl. No. 12/692,384.

* cited by examiner

*Primary Examiner* — Tanisha Diggs

(74) *Attorney, Agent, or Firm* — Hovey Williams LLP

(57) ABSTRACT

Compositions and methods for reducing stress corrosion cracking in steel vessels used for storing and/or transporting ethanol-containing fluids. Additives including oxygen scavengers and film-forming additives can be employed together in such ethanol-containing fluids (e.g., fuel grade ethanol) to mitigate stress corrosion cracking in steel vessels, such as pipelines, storage tanks, rail cars, and/or tanker trucks.

8 Claims, 2 Drawing Sheets

METHODS AND COMPOSITIONS FOR REDUCING STRESS CORROSION CRACKING

RELATED APPLICATION

Figure 1:
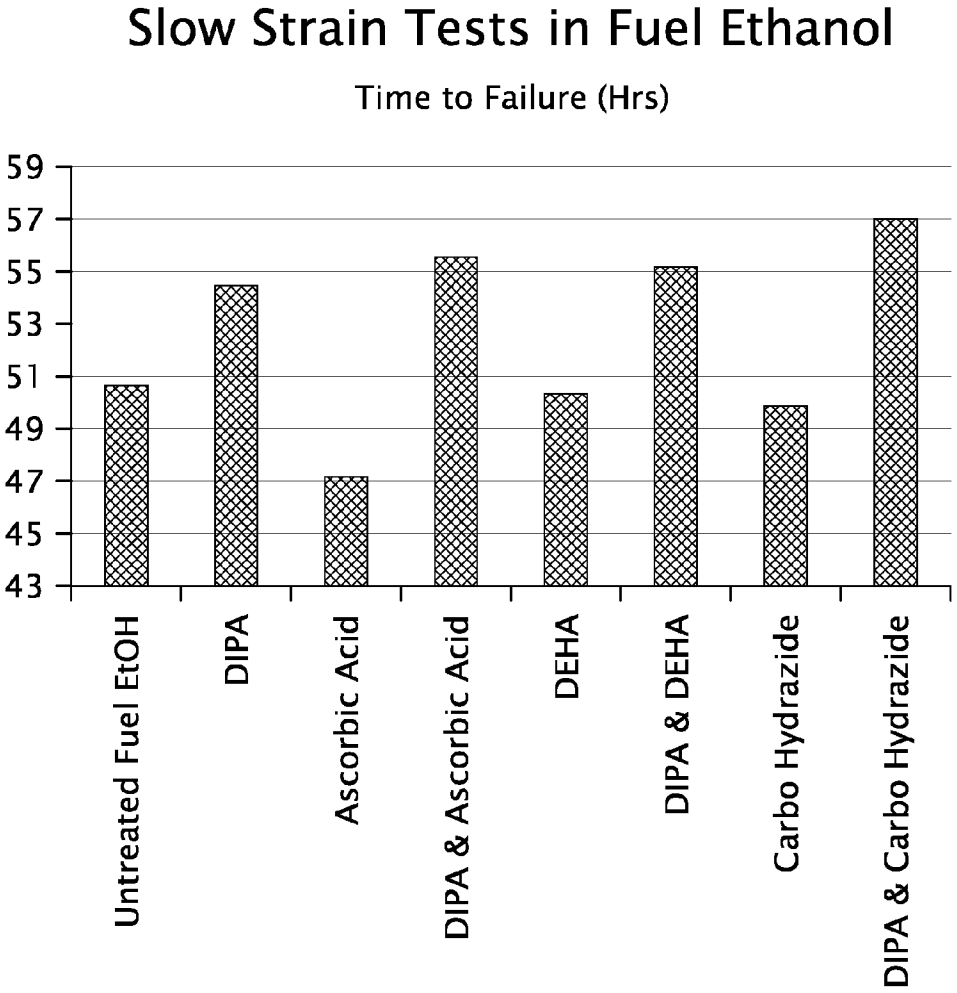

This application is a division of U.S. patent application Ser. No. 12/692,384, filed Jan. 22, 2010, now abandoned and titled "Methods and Compositions for Reducing Stress Corrosion Cracking."

BACKGROUND

1. Field

One or more embodiments of the invention relate to methods and compositions for reducing stress corrosion cracking in steel vessels used for storing and/or transporting ethanol-containing fluids.

2. Description of Related Art

Ethanol is becoming an increasingly important resource in the United States and around the world, particularly for use as fuel or a fuel additive. For instance, the United States requires gasoline sold in certain areas of the country to contain a designated percentage of oxygenates, the most common of which being ethanol and methyl-t-butyl ether ("MTBE"). However, MTBE has recently been found to contaminate ground water supplies. Thus, the demand for ethanol in the United States is higher than ever. To cope with this demand, increased supplies of ethanol are being transported using various means from the heartland, where the majority of U.S. ethanol is produced, to coastal regions, where the majority of ethanol is consumed. It has been observed, however, that transportation and storage of ethanol, and particularly fuel grade ethanol, can cause stress corrosion cracking in steel vessels used in transporting and storing ethanol. Accordingly, methods and compositions may be desired to mitigate such stress corrosion cracking.

SUMMARY

One embodiment of the invention concerns a method for reducing stress corrosion cracking in a steel vessel for storing and/or transporting an ethanol-containing fluid. The method of this embodiment comprises introducing an oxygen scavenger and a film-forming additive into said vessel either concurrently or sequentially with said ethanol-containing fluid.

BRIEF DESCRIPTION OF THE DRAWING FIGURES

Figure 2:
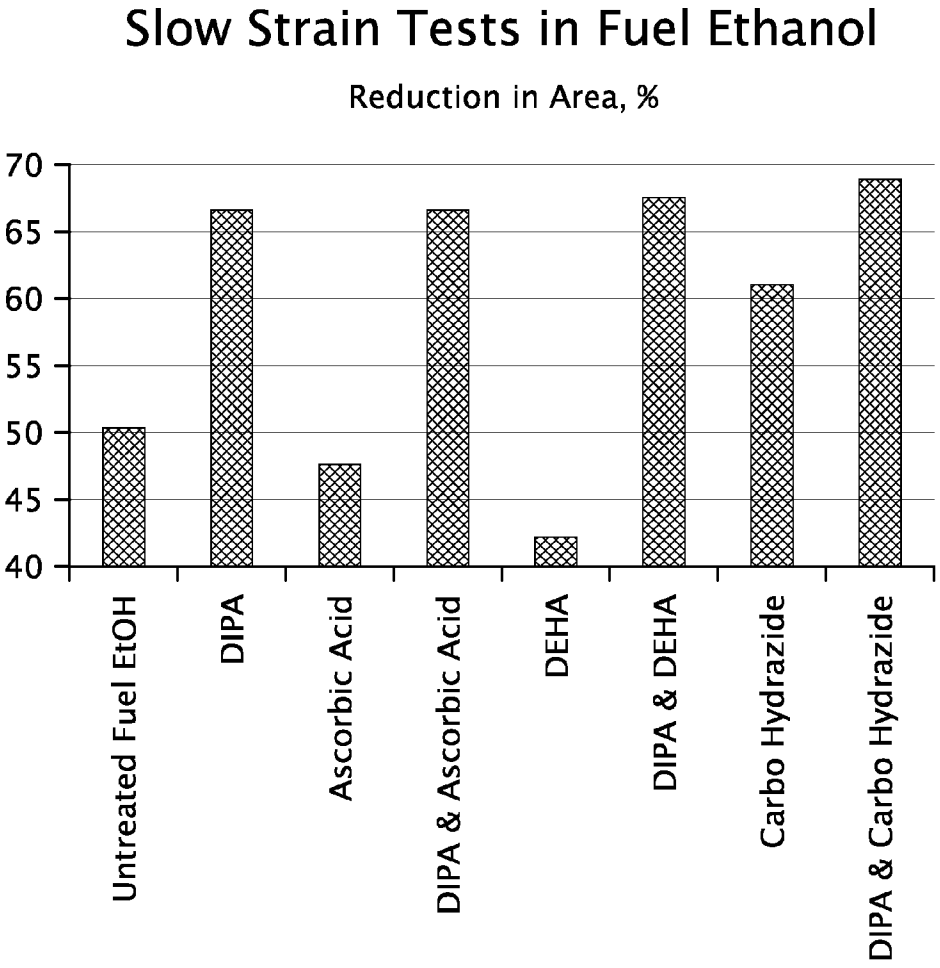

Embodiments of the present invention are described herein with reference to the following drawing figures, wherein:

FIG. 1 is a bar chart comparing time-to-failure results of steel specimens in contact with untreated fuel grade ethanol, fuel grade ethanol treated with oxygen scavengers, and fuel grade ethanol treated with oxygen scavengers and film-forming additives; and FIG. 2 is a bar chart comparing reduction in area results of steel specimens in contact with untreated fuel grade ethanol, fuel grade ethanol treated with oxygen scavengers, and fuel grade ethanol treated with oxygen scavengers and film-forming additives.

DETAILED DESCRIPTION

In accordance with various embodiments of the present invention, compositions comprising an oxygen scavenger and a film-forming additive can be prepared and employed to mitigate stress corrosion cracking in steel vessels used for storing and/or transporting ethanol-containing fluids. These compositions can be introduced into such vessels concurrently or sequentially with ethanol-containing fluids for pretreatment and/or maintenance of the steel vessels.

As just mentioned, an oxygen scavenger can be employed in various embodiments of the present invention to aid in mitigating stress corrosion cracking in steel vessels used for storing and/or transporting ethanol-containing fluids. As used herein, the term "oxygen scavenger" shall denote any chemical compound or element that reacts with elemental oxygen (e.g., $O_2$) in a system thereby lowering the elemental oxygen content of such system. For example, hydrazine ($N_2H_4$) can be employed as an oxygen scavenger, which lowers the elemental oxygen content of a system by reacting with elemental oxygen to form water and elemental nitrogen according to the following equation:

$$N_2H_4+O_2 \rightarrow 2H_2O+N_2$$

In one or more embodiments, the selected oxygen scavenger(s) can be one that adds no solids, carbon dioxide, or organic acids to the ethanol-containing fluid. Additionally, the selected oxygen scavenger(s) can be substantially soluble in ethanol (e.g., fuel grade ethanol). Examples of chemical compounds suitable for use as oxygen scavengers in various embodiments of the present invention include, but are not limited to, hydrazine, sodium sulfite, carbohydrazide, erythorbate, methylethylketoxime, N,N'-diethylhydroxylamine ("DEHA"), hydroquinone, acetone oxime, diethyl sulfite, ascorbic acid, acetone azine, 2,6-di-tert-butyl phenol, butylated hydroxytoluene, urea, biuret, and mixtures thereof. Such oxygen scavengers can be purchased under a variety of commercial names. For example, a carbohydrazide-containing oxygen scavenger having the trade name ELIMIN-OX™ and an erythorbate-containing oxygen scavenger having the trade name SUR-GUARD™ can each be purchased from Nalco Company, a methylethyl ketoxime-containing oxygen scavenger having the trade name MEKOR™ can be purchased from Drew Chemical, and diethyl hydroxylamine-containing oxygen scavengers having the trade names STEAMATE™, NEUTROX™, and CONQUOR™ can be purchased from Dearborn Chemical and Calgon. Additionally, oxygen scavengers containing mixtures of chemical compounds can be employed in various embodiments of the invention, either individually or in combination with other oxygen scavengers. For example, ETHANOX™ 4740 is a commercially available oxygen scavenger containing a proprietary mixture of hindered phenols and diamines available from Albemarle Corporation. Other examples of such commercially available oxygen scavengers include, but are not limited to, MCC 5011 (a proprietary mixture of fatty acids and polymerized fatty acids) and MCC 5011 pHe (a proprietary mixture of fatty acids and polymerized fatty acids with 0.05% ammonia), each available from MidContinental Chemical Company, Inc. In one or more embodiments, the oxygen scavenger(s) employed can comprise ascorbic acid, carbohydrazide, and/or DEHA. It should be noted that, although hydrazine is mentioned above as being suitable for use in the present invention, its use may not be desirable for all applications given its high toxicity and volatility.

As mentioned above, the oxygen scavenger can be employed with ethanol-containing fluids to aid in mitigating stress corrosion cracking in steel vessels. In one or more embodiments, the oxygen scavenger can be introduced into the steel vessel in an amount of at least stoichiometric equivalence to the dissolved oxygen (i.e., $O_2$) content of the ethanol-containing fluid. In other words, if the selected oxygen scavenger reacts with molecular oxygen at a molar ratio of 2:1, then the amount of oxygen scavenger employed can be at least two moles per every mole of dissolved oxygen in the ethanol-containing fluid. In one or more embodiments, the oxygen scavenger can be introduced into the steel vessel in an amount sufficient to create a stoichiometric excess of oxygen scavenger of at least 1.1, at least 1.5, or at least 2 times the equivalent amount of dissolved oxygen in the ethanol-containing fluid. In other embodiments, the oxygen scavenger can be introduced into the steel vessel in an amount sufficient to create a molar ratio of oxygen scavenger to dissolved oxygen in the ethanol-containing fluid in the range of from about 0.1:1 to about 10:1, in the range of from 0.5:1 to about 5:1, or in the range of from 1:1 to 3:1 oxygen scavenger-to-dissolved oxygen. Additionally, in various embodiments, the oxygen scavenger can be introduced into the steel vessel in an amount sufficient to be present in the ethanol-containing fluid in an amount of at least 1 part per million by weight ("ppmw"), in the range of from about 2 to about 1,000 ppmw, in the range of from about 10 to about 500 ppmw, or in the range of from 25 to 250 ppmw. Furthermore, as mentioned above, the oxygen scavenger can be employed along with a film-forming additive in the steel vessel. In one or more embodiments, the oxygen scavenger can be present in a molar ratio with the film-forming additive in the range of from about 1:5 to about 1:10, or in the range of from 1:7 to 1:9 oxygen scavenger-to-film-forming additive.

As mentioned above, a film-forming additive can be employed in various embodiments of the present invention. As used herein, the term "film-forming additive" shall denote any chemical compound or element that provides a protective coating on a surface to prevent or deter interaction of such surface with other chemical elements or compounds. Particularly, film-forming additives employed in various embodiments can be those that form protective coatings on a steel surface. Additionally, film-forming additives suitable for use in various embodiments of the present invention can be substantially soluble in ethanol (e.g., fuel grade ethanol). In one or more embodiments, the film-forming additive can be an amine. Additionally, the film-forming additive can have the following structure:

formula (I)

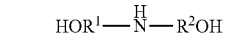

$R^1$ and $R^2$ of formula (I) can independently be any substituted or unsubstituted alkylene or arylene groups having a carbon number of from 1 to 20, and may include heteroatoms. Additionally, alkylene groups suitable for use as $R^1$ and $R^2$ can be straight, branched, or cyclic, and can be saturated or unsaturated. In one or more embodiments, $R^1$ and $R^2$ can independently be straight-chain or branched $C_1$ to $C_{12}$ alkylene groups. Additionally, $R^1$ and $R^2$ can independently be saturated, unsubstituted, straight-chain or branched $C_2$ to $C_9$ alkylene groups. Additionally, in various embodiments, $R^1$ and $R^2$ can comprise alkylene or arylene groups having like structures. Examples of chemical compounds suitable for use as film-forming additives in various embodiments of the present invention include, but are not limited to, diethanol amine, diisopropanol amine, dibutanol amine, and mixtures thereof. Such film-forming additives can be purchased under a variety of commercial names from suppliers such as Dow Chemical and BASF Chemical. In one or more embodiments, the film-forming additive can comprise diethanol amine and/or diisopropanol amine.

As mentioned above, the film-forming additive can be employed to aid in mitigating stress corrosion cracking in steel vessels from ethanol-containing fluids. In one or more embodiments, the film-forming additive can be introduced into the steel vessel in an amount sufficient to create a concentration in the ethanol-containing fluid of at least 1 ppmw, in the range of from about 2 to about 1,000 ppmw, in the range of from about 10 to about 500 ppmw, or in the range of from 25 to 250 ppmw. Furthermore, as mentioned above, the film-forming additive can be employed along with an oxygen scavenger in the ethanol-containing fluid.

In one or more embodiments, the above-mentioned ethanol-containing fluid can be any fluid that contains at least 50, at least 75, at least 90, or at least 95 weight percent ethanol. Also, it should be noted that, although the term "fluid" is employed herein, the ethanol-containing fluid may also contain solid components in addition to any liquid and/or vapor components present. In one or more embodiments, the ethanol-containing fluid contains substantially no solids or no solids. Additionally, in various embodiments, the ethanol-containing fluid can have a concentration of dissolved oxygen in the range of from about 1 to about 50 ppmw, in the range of from about 3 to about 30 ppmw, or in the range of from 5 to 10 ppmw. Furthermore, in various embodiments, the ethanol-containing fluid can have a water content of less than 5 weight percent, less than 3 weight percent, or less than 1 weight percent. Additionally, in various embodiments, the ethanol-containing fluid can have a total hydrocarbon content of less than 5 weight percent, less than 3 weight percent, or less than 1 weight percent. In one or more embodiments, the ethanol-containing fluid can be fuel grade ethanol. As used herein, the term "fuel grade ethanol" shall denote an ethanol-containing fluid as defined by ASTM D 4806-09.

The above-described oxygen scavengers and film-forming additives can be employed in an ethanol-containing fluid under various conditions. Accordingly, in one or more embodiments, the ethanol-containing fluid can have temperature in the range of from about 20 to about 80° F., or in the range of from 50 to 70° F. Additionally, the ethanol-containing fluid can be under a pressure in the range of from about 0 to about 100 pounds per square inch. Furthermore, the ethanol-containing fluid can be substantially in liquid form.

As mentioned above, the compositions of the present invention can be employed to mitigate stress corrosion cracking in steel vessels. As used herein, the term "steel vessel" shall denote any type of vessel employed for storing and/or transporting liquids that is predominately made from a metal or metal alloy. As used herein, the term "predominately" shall mean greater than 50 percent. In one or more embodiments, the metal of the steel vessel can comprise steel. In one or more embodiments, the steel vessel can comprise at least 60, at least 70, at least 80, at least 90, at least 95, or at least 99 weight percent steel. Additionally, the steel vessel can take any shape or size suited to the storage and/or transportation of an ethanol-containing fluid, such as fuel grade ethanol. In various embodiments, the steel vessel can be selected from the group consisting of a storage tank, a rail car, a pipeline, and a tanker truck.

When steel is employed in forming the above-described steel vessels, the steel can be any variety of steel known or hereafter discovered in the art. For example, carbon steels, low alloy steels, austenitic stainless steels, ferritic stainless steels, duplex stainless steels, and/or chromium alloy steels can be employed in the various embodiments described herein. In one or more embodiments, the steel can be a carbon steel. As used herein, the term "carbon steel" shall denote steel that is not stainless steel. Additionally, in one or more embodiments, the steel can comprise ASTM grade A36, A 53, and/or A 516-70 steel. Furthermore, although the term "steel" is employed to describe the vessels herein, such use is merely for convenience as the vessels described herein are not actually required to contain steel. Any other metals known or hereafter discovered in the art can be employed in the various embodiments described herein. For instance, aluminum, titanium, copper, nickel, and/or chromium metals or their alloys can constitute at least a portion of such steel vessels.

The above-described composition can be prepared by any methods known or hereafter discovered in the art. In one or more embodiments, the oxygen scavenger and the film-forming additive can be combined and mixed employing any methods known or hereafter discovered in the art. Additionally, the oxygen scavenger and film-forming additive can be combined and optionally pre-dissolved in ethanol, such as fuel grade ethanol, and/or distilled water. When the oxygen scavenger and film-forming additive are pre-dissolved in ethanol, the ethanol can be present in the composition in an amount in the range of from about 10 to about 96 mole percent, or in the range of from 90 to 96 mole percent. Additionally, the oxygen scavenger can be present in a concentration in the range of from about 5 to about 1,000 ppmw, or in the range of from 5 to 50 ppmw based on the weight of the solvent (e.g., the ethanol and/or water). Furthermore the film-forming additive can be present in a concentration in the range of from about 20 to about 4,000 ppmw, or in the range of from 20 to 200 ppmw based on the weight of the solvent. When distilled water is employed in the composition, it can be present in a concentration in the range of from about 2.5 to about 300 ppmw, or in the range of from 2.5 to 25 ppmw based on the weight of ethanol in the composition.

In one or more embodiments, the above-described compositions can be employed to mitigate stress corrosion cracking in a steel vessel by introducing the oxygen scavenger and film-forming additive either substantially simultaneously or separately into the steel vessel. Such introduction can be accomplished by injection into the vessel or by any methods known or hereafter discovered in the art. For example, the oxygen scavenger and film-forming additive can be introduced concurrently with an ethanol-containing fluid (i.e., with a pretreated ethanol-containing fluid), or they can be introduced into a vessel already containing an ethanol-containing fluid.

As mentioned above, it is believed that the film-forming additive component of the composition works by coating at least a portion of the internal surface of the steel vessel. This is accomplished by simply including the film-forming additive in the ethanol-containing fluid. Though not wishing to be bound by theory, it is believed that the film-forming additive migrates to the vessel surface through the polarity of the amine moiety of the film-forming additive.

In one or more embodiments, treatment of the steel vessel can be, but need not be, performed in two phases. First, a higher concentration of the above-described oxygen scavengers and film-forming additives can be employed to form a pretreated vessel. In this first phase, the composition can be introduced in an amount sufficient to result in a combined concentration of film-forming additive and oxygen scavenger in an ethanol-containing fluid of at least 1,000 ppmw, in the range of from about 1,000 to about 5,000 ppmw, or in the range of from 2,000 to 4,000 ppmw. Thereafter, as additional ethanol-containing fluid is added to or flows through the pretreated vessel, additional oxygen scavenger and film-forming additive can be added in an amount sufficient to result in a combined concentration in the ethanol-containing fluid in the range of from about 1 to about 1,000 ppmw, in the range of from about 10 to about 500 ppmw, or in the range of from 25 to 250 ppmw. In other embodiments, the pretreatment step can be excluded.

In one or more embodiments, when the steel vessel comprises a pipeline, the ethanol-containing fluid can be substantially continuously flowing through the pipeline. In such embodiments, the oxygen scavenger and film-forming additive can initially be substantially continuously introduced at a rate sufficient to produce a treated ethanol-containing fluid having a combined concentration of oxygen scavenger and film-forming additive of at least 1,000 ppmw, in the range of from about 1,000 to about 5,000 ppmw, or in the range of from 2,000 to 4,000 ppmw. This initial pretreatment can be sustained for a time period of at least 1 minute, at least 5 minutes, at least 10 minutes, in the range of from about 1 minute to about 24 hours, in the range of from 5 minutes to about 12 hours, or in the range of from 10 minutes to 1 hour. Following pretreatment, the pipeline treatment can be maintained by substantially continuously introducing the oxygen scavenger and film-forming additive at a rate sufficient to produce a treated ethanol-containing fluid having a combined concentration of oxygen scavenger and film-forming additive in the range of from about 1 to about 1,000 ppmw, in the range of from about 10 to about 500 ppmw, or in the range of from 25 to 250 ppmw. As used herein, the term "substantially continuously" shall mean an operational period of at least 10 hours interrupted by a total non-operational period of less than 10 minutes.

In one or more embodiments, the oxygen scavenger can be present in the ethanol-containing fluid according to any of the above-described procedures in an amount sufficient to reduce the dissolved oxygen content of the ethanol-containing fluid by at least 50 mole percent, at least 60 mole percent, at least 70 mole percent, at least 80 mole percent, at least 90 mole percent, or at least 95 mole percent. Additionally the film-forming additive can initially be present in the ethanol-containing fluid in an amount sufficient to create a coating that covers at least 50, at least 60, at least 70, at least 80, at least 90, or at least 95 percent of the surface area of the inner surface of the steel vessel. Additionally, when the above-described pretreatment procedure is performed, the film-forming additive can be substantially continuously added in an amount sufficient to maintain a coating that covers at least 50, at least 60, at least 70, at least 80, at least 90, or at least 95 percent of the surface area of the inner surface of the steel vessel.

The following examples are intended to be illustrative of the present invention in order to teach one of ordinary skill in the art to make and use the invention and are not intended to limit the scope of the invention in any way.

EXAMPLES

Example 1

Slow Strain Rate Testing of Single-Treated Fuel Grade Ethanol

The effect on stress corrosion cracking on a steel sample of 13 different additives, either oxygen scavengers or film-forming additives, in fuel grade ethanol was determined in this Example. All testing was performed pursuant to the procedures outlined in ASTM G 129. Each of the additives was combined with a fuel grade ethanol at the concentration indicated in Table 1, below, which was then employed to determine the respective additive's efficacy at reducing stress corrosion cracking of a steel sample according to ASTM G 129. A 5 weight percent solution of oxygen scavenger or film-forming additive composition in fuel grade ethanol was prepared by weighing 5 grams of oxygen scavenger or film-forming additive and 95 grams of fuel grade ethanol. The oxygen scavenger or film-forming additive was then dissolved in the 95 g of fuel grade ethanol over a period of about 1 minute at room temperature. Ten mL of the resulting solution was pipetted into a 100-mL volumetric flask and diluted to the mark with fuel grade ethanol. This yielded 1,000 mL of fuel grade ethanol containing 500 ppmw of either oxygen scavenger or film-forming additive.

The fuel grade ethanol employed in each test met the standards of ASTM D4806-09 and contained 8 ppm of dissolved oxygen. The steel sample employed in each test was API 5L×46 Line Pipe steel. Additionally, the steel sample had a size of 7 inches by 0.25 inch diameter. Additionally, each test was performed at a strain rate of $10^{-6}$ inches/inch-second. The size of the fuel sample employed in each test was 500 mL. A summary of samples tested and their respective results regarding stress corrosion cracking is provided in Table 1, below.

TABLE 1

Slow Strain Rate Testing of Single-Treated Fuel Grade Ethanol

| Sample | Type | Chemical Supplier | Conc.* (ppmw) | Result |
|---|---|---|---|---|
| ETHANOX ™ 4740 (as supplied) | $O_2$ Scavenger | Albemarle Corp. | 100<br>500 | Severe cracking<br>Severe cracking |
| ETHANOX ™ 4740 (90 v. %) & MCC 5011 (10 v. %) | $O_2$ Scavenger | Albemarle Corp.; MidContentinental Chemical, Inc. | 100<br>500 | Severe cracking<br>Severe cracking |
| ETHANOX ™ 4740 (90 v. %) & MCC 5011 pHe (10 v. %) | $O_2$ Scavenger | Albemarle Corp.; MidContentinental Chemical, Inc. | 100<br>500 | Severe cracking<br>Severe cracking |
| Hydroquinone (25 v. % solution in isopropyl alcohol) | $O_2$ Scavenger | Aldrich Chemical | 500 | Severe cracking |
| Acetone Oxime (25 v. % solution in isopropyl alcohol) | $O_2$ Scavenger | Aldrich Chemical | 500 | Severe cracking |
| Diethyl Sulfite (as supplied) | $O_2$ Scavenger | Aldrich Chemical | 500 | Severe cracking |
| Acetone Azine (as supplied) | $O_2$ Scavenger | Aldrich Chemical | 500 | Severe cracking |
| Ascorbic Acid† | $O_2$ Scavenger | Aldrich Chemical | 500 | Severe cracking |
| Hydrazine (as supplied) | $O_2$ Scavenger | Aldrich Chemical | 500 | Minor cracking |
| Carbohydrazide | $O_2$ Scavenger | Aldrich Chemical | 500 | Severe cracking |
| N,N'-diethyl hydroxylamine | $O_2$ Scavenger | Aldrich Chemical | 500 | Severe cracking |
| Diethanol Amine (as supplied) | Film Former | Dow Chemical | 500 | Moderate cracking |
| Diisopropanol Amine ("DIPA") (as supplied) | Film Former | Dow Chemical | 500 | Moderate cracking |

*All concentrations provided are the effective concentration of the oxygen scavenger or film-forming additive in the fuel grade ethanol.
†Prepared by combining 10 parts ascorbic acid with 45 parts of fuel grade ethanol and 45 parts distilled water.

As can be seen from Table 1, above, fuel grade ethanol treated with only an oxygen scavenger does not sufficiently mitigate stress corrosion cracking in steel. The one exception to these results is hydrazine. However, as mentioned above, hydrazine is quite toxic and highly unstable, and, therefore, its use may be undesirable. Of course, as one skilled in the art would understand, minor cracking or very minor cracking are desired results from slow strain rate testing as such results indicate improved mitigation of stress corrosion cracking.

Example 2

Slow Strain Rate Testing of Dual-Treated Fuel Grade Ethanol

Four samples containing both an oxygen scavenger and a film-forming additive were prepared and dissolved in fuel grade ethanol, then tested according to the same conditions set forth in Example 1. The first sample contained a combination of ascorbic acid and 85 weight percent diisopropanol amine ("DIPA") and was prepared by first preparing a solution of ascorbic acid by dissolving 10 parts by weight of ascorbic acid in 45 parts by weight of fuel ethanol and 45 parts by weight distilled water. 10 parts by weight of this solution was then combined with 90 parts of the 85 weight percent DIPA. The second sample contained a combination of carbohydrazide and DIPA and was prepared by dissolving 25 parts by weight of commercial carbohydrazide in 75 parts by weight distilled water. 10 parts by weight of this solution was then combined with 90 parts by weight of the 85 weight percent DIPA. The third sample contained a combination of N,N'-diethylhydroxylamine ("DEHA") and DIPA and was prepared by combining 25 parts by weight of DEHA in 75 parts by weight distilled water, then heating the resulting mixture to 40° C. to dissolve the DEHA. 10 parts by weight of this solution was then added to 90 parts by weight of the 85 weight percent DIPA. Finally, the fourth sample contained a combination of hydrazine and DIPA and was prepared by combining 90 parts by weight of the 85 weight percent DIPA with 10 parts by weight of a commercial 50 percent solution of hydrazine dissolved in water. Each of these samples was then dispersed in fuel grade ethanol, as described above in Example 1, in an amount sufficient to create samples each having a combined concentration of film-forming additive and oxygen scavenger of 500 ppmw. A summary of samples tested and their respective results regarding stress corrosion cracking is provided in Table 2, below.

TABLE 2

Slow Strain Rate Testing of Dual-Treated Fuel Grade Ethanol

| Sample | Chemical Supplier | Conc.* (ppmw) | Result |
|---|---|---|---|
| Ascorbic Acid & DIPA | Aldrich Chemical Dow Chemical | 500 | Minor cracking |
| Carbohydrazide & DIPA | Aldrich Chemical Dow Chemical | 500 | Minor cracking |
| DEHA & DIPA | Aldrich Chemical Dow Chemical | 500 | Minor cracking |
| Hydrazine & DIPA | Aldrich Chemical Dow Chemical | 500 | Very minor cracking |

*All concentrations provided are the effective concentration of the oxygen scavenger and film-forming additive in the fuel grade ethanol.

As can be seen from the results above, all oxygen scavengers combined with a film-forming additive (i.e., DIPA) mitigated stress corrosion cracking in steel caused by fuel grade ethanol.

Example 3

Time-to-Failure from Treated and Untreated Fuel Grade Ethanol

The time-to-failure of eight steel samples was determined according to ASTM G-129 from an untreated fuel grade ethanol and seven samples of treated fuel grade ethanol. One of the treated samples contained only a film-forming additive, three of the treated fuel grade ethanol samples each contained only an oxygen scavenger, while the other three treated fuel grade ethanol samples each contained both an oxygen scavenger and a film-forming additive. The fuel grade ethanol is the same fuel grade ethanol as described above in Example 1. Additionally, each of the treated samples was the same as described above in Examples 1 and 2. A summary of the samples and the results obtained is provided below in Table 3.

TABLE 3

Time-to-Failure from Treated and Untreated Fuel Grade Ethanol

| Sample | Type | Conc.* (ppmw) | Time-to-Failure (hours) |
|---|---|---|---|
| Untreated Fuel Grade Ethanol | — | — | 50.7 |
| DIPA | Film Former | 500 | 54.5 |
| Ascorbic Acid | $O_2$ Scavenger | 500 | 47.2 |
| Carbohydrazide | $O_2$ Scavenger | 500 | 49.9 |
| DEHA | $O_2$ Scavenger | 500 | 50.4 |
| Ascorbic Acid & DIPA | $O_2$ Scavenger & Film Former | 500 | 55.6 |
| Carbohydrazide & DIPA | $O_2$ Scavenger & Film Former | 500 | 57.0 |
| DEHA & DIPA | $O_2$ Scavenger & Film Former | 500 | 55.2 |

*All concentrations provided are the effective concentration of the oxygen scavenger and/or film-forming additive in the fuel grade ethanol.

The results provided in Table 3, above, clearly indicate an improved performance in mitigating steel corrosion from fuel grade ethanol by employing a combined oxygen scavenger and film-forming additive in the ethanol. The results listed in Table 3 are also visually depicted in FIG. 1. As perhaps can more easily be seen by looking at FIG. 1, the combination of an oxygen scavenger and a film-forming additive seems to actually have a synergistic effect. This is because not only did the oxygen scavengers not perform well on their own, they actually decreased the time-to-failure of the steel sample compared to the untreated fuel grade ethanol. However, when combined with a film-forming additive, the combination unexpectedly yielded improved resistance to corrosion over the use of DIPA alone.

Example 4

Reduction in Area from Treated and Untreated Fuel Grade Ethanol

The area reduction, which measures the difference in area after fracture of a test specimen to the area of a control specimen, of eight steel samples was determined according to ASTM G-129 from an untreated fuel grade ethanol (control specimen) and seven samples of treated fuel grade ethanol. The untreated fuel grade ethanol and the seven treated samples are all the same as employed in Examples 1-3. A summary of the samples and the results obtained is provided below in Table 4.

TABLE 4

Reduction in Ara from Treated and Untreated Fuel Grade Ethanol

| Sample | Type | Conc.* (ppmw) | Area Reduction (%) |
|---|---|---|---|
| Untreated Fuel Grade Ethanol | — | — | 50.4 |
| DIPA | Film Former | 500 | 66.7 |
| Ascorbic Acid | $O_2$ Scavenger | 500 | 47.7 |
| Carbohydrazide | $O_2$ Scavenger | 500 | 61.1 |
| DEHA | $O_2$ Scavenger | 500 | 42.2 |
| Ascorbic Acid & DIPA | $O_2$ Scavenger & Film Former | 500 | 66.7 |
| Carbohydrazide & DIPA | $O_2$ Scavenger & Film Former | 500 | 69.0 |
| DEHA & DIPA | $O_2$ Scavenger & Film Former | 500 | 67.6 |

*All concentrations provided are the effective concentration of the oxygen scavenger and/or film-forming additive in the fuel grade ethanol.

The results provided in Table 4, above, clearly indicate an improved performance in mitigating steel corrosion from fuel grade ethanol by employing a combined oxygen scavenger and film-forming additive in the ethanol. The results listed in Table 4 are also visually depicted in FIG. 2. As perhaps can more easily be seen by looking at FIG. 2, the combination of an oxygen scavenger and a film-forming additive seems to actually have a synergistic effect. This is because not only did the oxygen scavengers not perform well on their own, two of them (the ascorbic acid and DEHA) actually decreased the reduction in area of the steel sample when employed alone in fuel grade ethanol. However, when combined with a film-forming additive, the combination unexpectedly yielded the same (as in the case of ascorbic acid) or improved (as in the case of carbohydrazide and DEHA) resistance to corrosion over the use of DIPA alone. Additionally, even though ascorbic acid combined with the film-forming additive yielded the same result, an improvement may actually be gleaned from this fact, given the much lower concentration of the film-forming additive employed during this run.

It should be understood that, although DIPA was the only film-forming additive combined with oxygen scavengers in the preceding examples, the compositions described herein are not limited to this embodiment alone.

The preferred forms of the invention described above are to be used as illustration only, and should not be utilized in a limiting sense in interpreting the scope of the present invention. Obvious modifications to the exemplary embodiments and modes of operation, as set forth herein, could be readily made by those skilled in the art without departing from the spirit of the present invention.

The inventor hereby states his intent to rely on the Doctrine of Equivalents to determine and assess the reasonably fair scope of the present invention as pertains to any compositions and/or methods not materially departing from but outside the literal scope of the invention as set forth in the following claims.

Selected Definitions

It should be understood that the following is not intended to be an exclusive list of defined terms. Other definitions may be provided in the foregoing description accompanying the use of a defined term in context.

As used herein, the terms "a," "an," and "the" mean one or more.

As used herein, the term "and/or," when used in a list of two or more items, means that any one of the listed items can be employed by itself or any combination of two or more of the listed items can be employed. For example, if a composition is described as containing components A, B, and/or C, the composition can contain A alone; B alone; C alone; A and B in combination; A and C in combination; B and C in combination; or A, B, and C in combination.

As used herein, the terms "comprising," "comprises," and "comprise" are open-ended transition terms used to transition from a subject recited before the term to one or more elements recited after the term, where the element or elements listed after the transition term are not necessarily the only elements that make up the subject.

As used herein, the terms "containing," "contains," and "contain" have the same open-ended meaning as "comprising," "comprises," and "comprise" provided above.

As used herein, the terms "having," "has," and "have" have the same open-ended meaning as "comprising," "comprises," and "comprise" provided above.

As used herein, the terms, "including," "include," and "included" have the same open-ended meaning as "comprising," "comprises," and "comprise" provided above.

What is claimed is:

1. A method for reducing stress corrosion cracking in a steel vessel used for storing and/or transporting fuel grade ethanol, said method comprising: pretreating said steel vessel by introducing an oxygen scavenger and a film-forming additive into said steel vessel either concurrently or sequentially with said fuel grade ethanol in a combined concentration of 500 parts per million by weight ("ppmw") based on the weight of said fuel grade ethanol, thereby forming a pretreated vessel;

wherein said oxygen scavenger is selected from the group consisting of carbohydrazide, N,N'-diethylhydroxylamine, ascorbic acid, and mixtures thereof, and wherein said film-forming additive is diisopropanol amine.

2. The method of claim 1, said method further comprising maintaining said pretreated vessel by adding additional oxygen scavenger and additional film-forming additive to said pretreated vessel, wherein said additional oxygen scavenger and said additional film-forming additive are present in a combined amount in the range of from about 1 to about 1,000 ppmw based on the weight of said fuel grade ethanol.

3. The method of claim 1, wherein said fuel grade ethanol comprises dissolved oxygen, wherein said oxygen scavenger is added to said fuel grade ethanol in an amount sufficient to reduce the dissolved oxygen concentration of said fuel grade ethanol by at least 50 mole percent.

4. The method of claim 3, wherein said oxygen scavenger is added to said fuel grade ethanol in an amount sufficient to create a molar ratio of said oxygen scavenger to said dissolved oxygen in the range of from about 0.1:1 to about 10:1 oxygen scavenger-to-dissolved oxygen.

5. The method of claim 1, wherein said oxygen scavenger and said film-forming additive are introduced to said steel vessel substantially simultaneously, wherein said oxygen scavenger and said film-forming additive are present in a molar ratio in the range of from about 1:5 to about 1:10 oxygen scavenger-to-film-forming additive.

6. The method of claim 1, wherein said steel vessel is selected from the group consisting of a storage tank, a rail car, a pipeline, and a tanker truck; wherein said steel vessel comprises greater than 50 weight percent steel.

7. The method of claim 1, wherein said fuel grade ethanol comprises a total amount of hydrocarbon in a concentration of less than 5 weight percent, water in an amount of less than 3 weight percent and dissolved oxygen in an amount in the range of from about 1 to about 50 ppmw.

8. The method of claim 1, wherein said steel vessel comprises a pipeline, wherein said fuel grade ethanol is substantially continuously flowing through said pipeline, wherein said method further comprises substantially continuously introducing said oxygen scavenger and said film-forming additive to said pretreated vessel at a rate sufficient to produce a treated fuel grade ethanol having a combined concentration of oxygen scavenger and film-forming additive in the range of from about 1 to about 1,000 ppmw.

* * * * *